United States Patent [19]

Robbins, III

[11] Patent Number: 4,930,644

[45] Date of Patent: Jun. 5, 1990

[54] THIN FILM CONTAINER WITH REMOVABLE LID AND RELATED PROCESS

[76] Inventor: Edward S. Robbins, III, 459 North Ct., Florence, Ala. 35630

[21] Appl. No.: 288,237

[22] Filed: Dec. 22, 1988

[51] Int. Cl.[5] ..... B65D 23/00

[52] U.S. Cl. ..... 215/1 C; 220/98; 220/403

[58] Field of Search ..... 220/4 F, 408, 403, 8; 215/11.6, 1 C

[56] References Cited

U.S. PATENT DOCUMENTS

| | | | |
|---|---|---|---|
| 1,048,935 | 12/1912 | Brady | 220/8 |
| 1,707,841 | 4/1929 | Broadfoot | 220/8 |
| 2,036,687 | 4/1936 | Fisher | 383/10 |
| 2,082,714 | 6/1937 | Midulla | 383/33 |
| 2,321,836 | 6/1943 | Marzo | 220/460 |
| 2,338,604 | 1/1944 | Silveyra | 229/14 |
| 2,352,503 | 6/1944 | Walton | 229/14 |
| 2,575,893 | 11/1949 | Seaman | 383/25 |
| 2,695,423 | 11/1954 | Pardee et al. | 18/19 |
| 2,876,113 | 3/1959 | Barton | 99/171 |
| 2,880,902 | 4/1959 | Owsen | 220/8 |
| 2,952,379 | 9/1960 | Potter | 220/6 |
| 2,985,915 | 5/1961 | Winstead | 18/19 |
| 3,039,648 | 6/1962 | Busch | 220/63 |
| 3,055,568 | 9/1962 | Zalkind | 220/461 |
| 3,101,839 | 8/1963 | Holman | 220/403 |
| 3,163,544 | 12/1964 | Valyi | 99/171 |
| 3,172,933 | 3/1965 | Flax | 264/248 |
| 3,179,323 | 1/1965 | Miller | 220/462 |
| 3,187,966 | 6/1965 | Klygis | 222/541 |
| 3,220,544 | 11/1965 | Lovell | 220/8 X |
| 3,255,932 | 6/1966 | Hunter et al. | 222/105 |
| 3,285,461 | 11/1966 | Santelli | 220/17 |
| 3,321,070 | 5/1967 | Childs | 220/403 |
| 3,529,647 | 9/1970 | Ignell | 215/12.1 |
| 3,545,643 | 12/1970 | Higgins | 220/63 |
| 3,565,280 | 2/1971 | Rausing | 220/63 |
| 3,567,104 | 3/1971 | Arslanian | 229/14 |
| 3,604,491 | 9/1971 | Spless | 150/8 |
| 3,606,962 | 9/1971 | Scholle | 222/530 |
| 3,643,854 | 2/1972 | Holmes | 229/14 B |
| 3,648,882 | 3/1972 | Shelton | 220/403 |
| 3,739,827 | 6/1973 | Sondel | 215/12.1 |
| 3,765,574 | 10/1973 | Urquiza | 222/183 |
| 3,784,039 | 1/1974 | Marco | 215/11 E |
| 3,861,577 | 1/1975 | Druyts | 220/461 |
| 3,864,771 | 2/1975 | Bauer et al. | 220/8 X |
| 3,872,994 | 3/1975 | Hyde | 215/1 C X |
| 3,900,120 | 8/1975 | Sincock | 215/1 C |
| 3,918,605 | 11/1975 | Butler | 220/63 R |
| 3,982,029 | 9/1976 | Rausing | 426/106 |
| 4,012,472 | 3/1977 | Lindsey | 222/180 |
| 4,027,427 | 6/1977 | Stoller et al. | 47/1.1 |
| 4,151,929 | 5/1979 | Sapien | 220/404 |

(List continued on next page.)

FOREIGN PATENT DOCUMENTS

| | | | |
|---|---|---|---|
| 489720 | 3/1975 | Australia . | |
| 84576 | 3/1977 | Australia . | |
| 0182094 | 10/1985 | European Pat. Off. . | |
| 1301970 | 11/1967 | Fed. Rep. of Germany | 220/8 |
| 587701 | 4/1925 | France | 220/8 |
| 2118955 | 5/1942 | France . | |
| 1287487 | 2/1962 | France . | |
| 1129609 | 10/1968 | United Kingdom . | |
| 2109247 | 6/1983 | United Kingdom | 215/11.6 |

*Primary Examiner*—Stephen P. Garbe
*Assistant Examiner*—Christine A. Peterson
*Attorney, Agent, or Firm*—Nixon & Vanderhye

[57] ABSTRACT

A collapsible thin film plastic container assembly is provided which includes a unitary extrusion blow molded container body having a main peripheral side wall portion, a closed lower end and an open upper end. The side wall has thickened upper and lower minor portions, the upper minor portion provided with means for receiving a removable lid. The thickened upper and lower portions permit the container to remain in a substantially upright, self-supporting position, but permit the main peripheral side wall portion to collapse upon exertion of an axially directed compressive force. The process includes extruding a parison and blow molding the parison within a mold to form the container.

22 Claims, 3 Drawing Sheets

U.S. PATENT DOCUMENTS

| | | | |
|---|---|---|---|
| 4,172,152 | 10/1979 | Carlisle | 426/127 |
| 4,174,051 | 11/1979 | Edwards et al. | 222/105 |
| 4,330,066 | 5/1982 | Berliner | 215/1 C |
| 4,397,643 | 8/1983 | Rygiel | 604/317 |
| 4,449,984 | 5/1984 | Cruz | 604/319 |
| 4,457,455 | 7/1984 | Meshberg | 222/103 |
| 4,459,793 | 7/1984 | Zenger | 53/434 |
| 4,467,929 | 8/1984 | Jakobsen et al. | 215/1 C |
| 4,471,882 | 9/1984 | Joo | 220/450 |
| 4,492,313 | 1/1985 | Touzani | 215/1 C |
| 4,560,085 | 12/1985 | Vom Hofe et al. | 220/465 |
| 4,591,060 | 5/1986 | Tsukada et al. | 215/31 X |
| 4,635,814 | 1/1987 | Jones | 220/403 |
| 4,653,671 | 3/1987 | Duffy | 222/105 |
| 4,671,427 | 6/1987 | Farquharson | 222/83.5 |
| 4,785,948 | 11/1988 | Strassheimer | 215/1 C |
| 4,795,062 | 1/1989 | Bedwell | 222/92 |
| 4,805,799 | 2/1989 | Robbins, III | 220/403 |
| 4,815,615 | 3/1989 | Phlaphongphanich | 215/11.1 |
| 4,818,545 | 4/1989 | Kunimoto | 426/107 |

FIG. 1
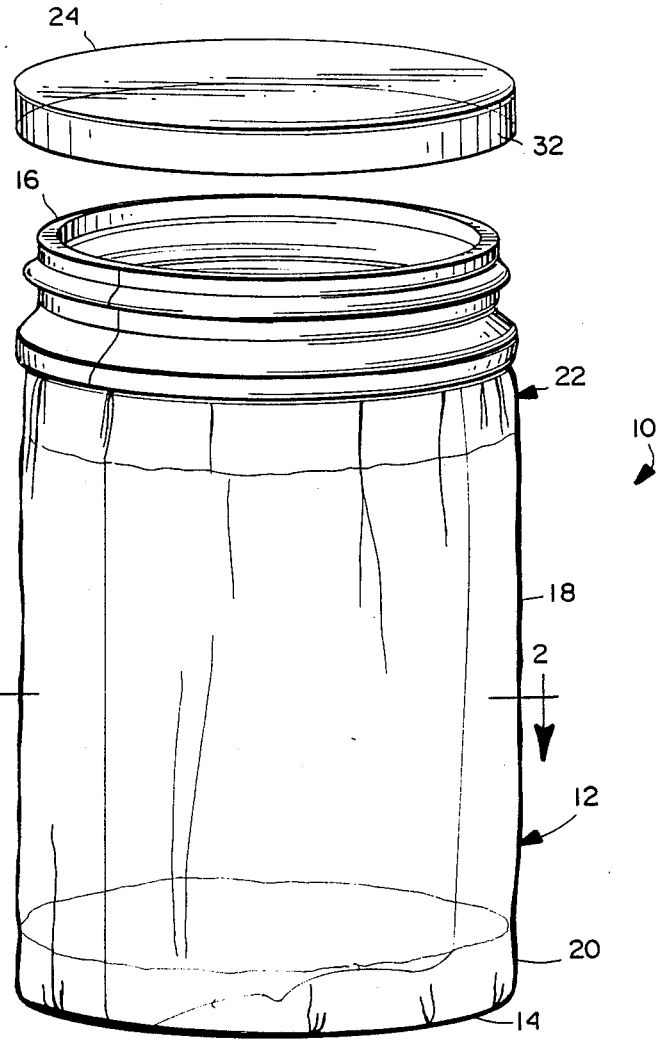
FIG. 2
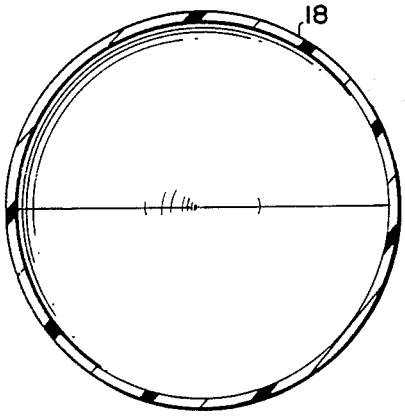
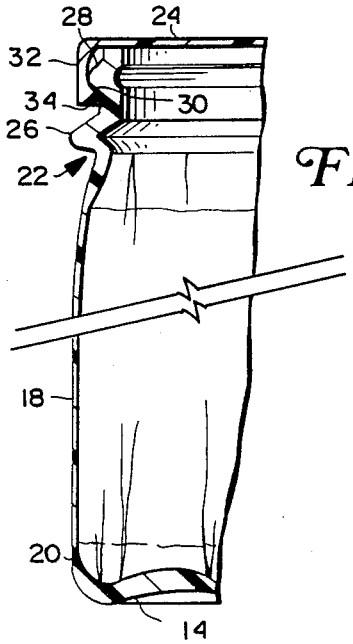
FIG. 3
FIG. 4
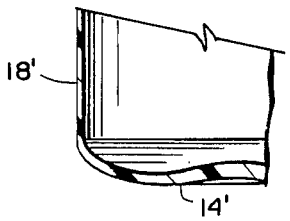
FIG. 5
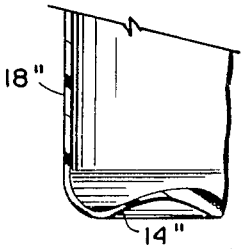

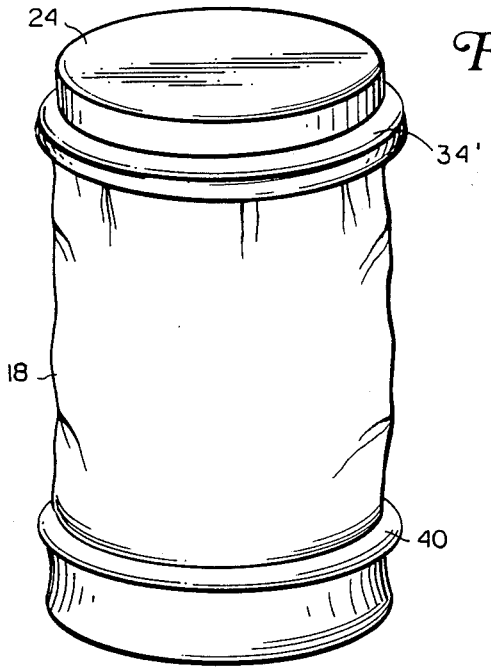
FIG. 6
FIG. 7
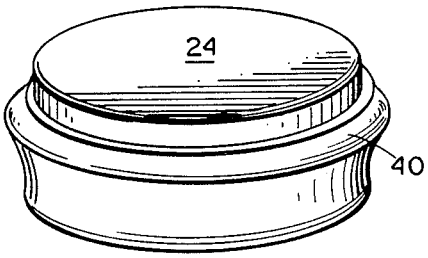
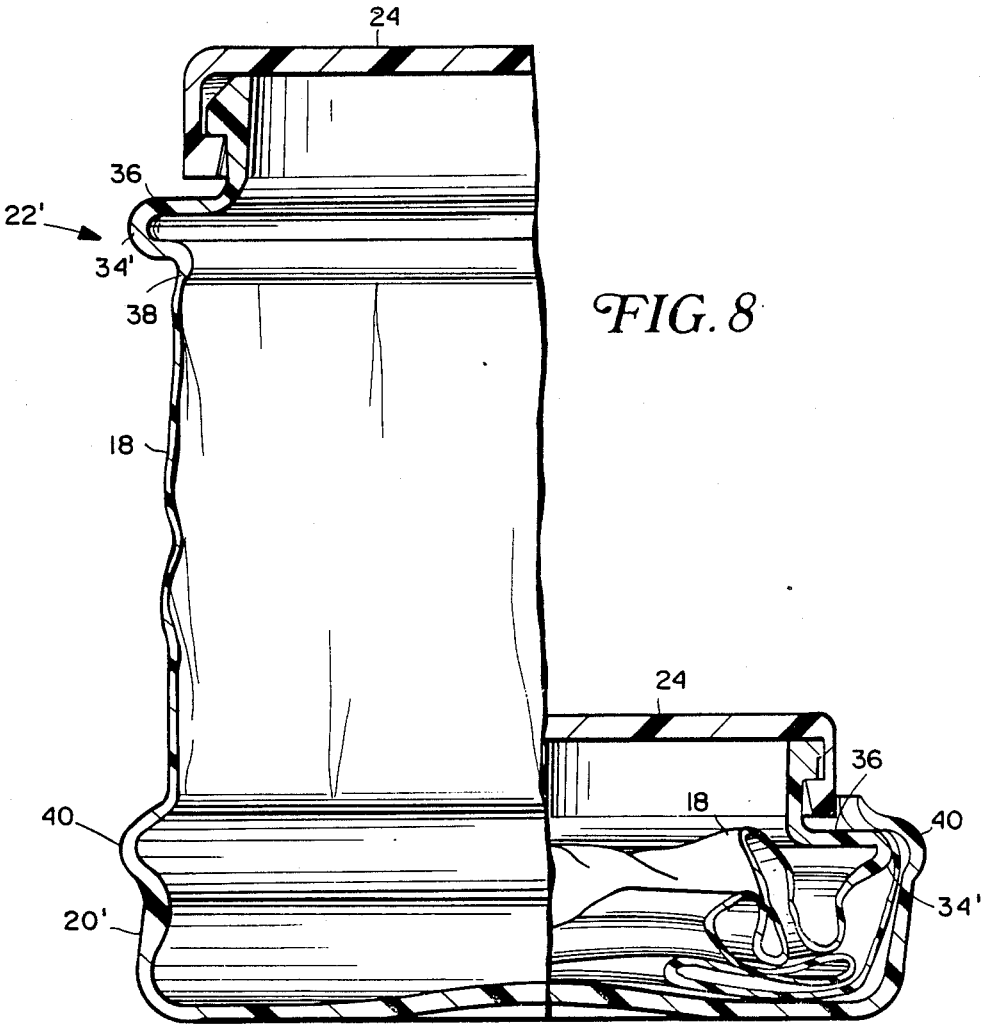
FIG. 8

THIN FILM CONTAINER WITH REMOVABLE LID AND RELATED PROCESS

BACKGROUND AND SUMMARY OF THE INVENTION

In the foodstuffs industry, containers of various sizes, shapes and compositions are utilized to hold a variety of food products. One common practice is to enclose the contents within a cardboard (or like material) box, with or without a flexible treated paper or plastic liner. Reclosing the box does not, however, effectively reseal the contents and freshness is difficult to maintain. Another technique is to provide a thin paper or plastic bag having a shape corresponding generally to a stack of food items, such as crackers, which is subsequently sealed. One or more of such bags is then inserted within an outer container or box. In most instances, the bag is unsealed, and often ripped open, and as food items are removed, the upper end of the liner or bag is rolled upon itself to form a smaller package. Again, the mere rolling down of the open portion of the bag does not provide a good seal, and the further enclosure within a box does not measurably improve the seal.

In accordance with the present invention, a thin film, self-supporting but collapsible bag is provided for holding food or other items. More specifically, a container is provided wherein a major portion of the length of which comprises a plastic thin film peripheral sidewall. Thicker upper and lower portions of the peripheral sidewall provide the required rigidity to support a removable lid, and to support the container in a normally upright position. However, axial pressure applied to either the top or bottom (or both) of the container will result in partial collapse of the container, to the extent permitted by the remaining contents.

In one exemplary embodiment, the container comprises a unitary extrusion, subsequently blow-molded, for example, to form a container having an open end and a closed end. In this exemplary embodiment, the container has a generally cylindrical shape from top to bottom, with a relatively wide mouth at the open end thereof. A thickened lower portion of the peripheral sidewall is provided which merges with a thickened bottom wall. At the upper, open end of the container, another thickened area is provided which includes means for receiving a removable lid or cover. In this regard, the upper thickened area may have a slightly smaller diameter than the remaining peripheral sidewall portion of the container, so that the removable lid or cover, when applied, will not extend radially beyond the container body to any significant degree.

It will be understood by those of ordinary skill in the art that the removable lid or cover may be of the snap-on or screw-thread type, and the profile of the upper thickened portion of the sidewall will be provided with annular ribs or screw threads, as appropriate, depending on the type of closure employed.

Variations in the lower areas of the container construction are also within the scope of the invention. For example, the lower, thickened area of the peripheral sidewall may be omitted, so that the thin walled peripheral side wall joins directly, or merges with a thickened bottom wall.

In another alternative configuration, the bottom wall may be thickened only in a central portion thereof.

In still another arrangement in accordance with the subject invention, the upper and lower thickened portions of the peripheral sidewall may be provided with radially outwardly extending peripheral beads which, upon collapse of the thin film sidewall portion, can be snapped together to maintain the container in this collapsed position, until the respective upper and lower portions are pulled apart to, for example, refill the container.

It will also be appreciated that the cross-sectional shape of the container may be varied, e.g., it may be circular, oval, rectangular, etc.

Other variations are also within the scope of the invention. For example, patterns, such as a "quilted" pattern, may be incorporated into the production of the thin walled area of the peripheral sidewall to add a measure of rigidity to this area of the container, but without eliminating the otherwise desirable collapsibility feature.

As noted above, a preferred process of forming containers in accordance with this invention involves the extrusion of a tubular parison between a pair of separated mold halves, the parison having been extruded to provide upper and lower areas with increased thickness as compared to the major peripheral portion of the sidewall. Thereafter, the mold halves, which are formed generally to provide the desired container shape, are closed and the parison blown into engagement with the interior surfaces of the mold. The upper and lower ends of the molds are provided with more detailed surfaces designed to provide the exact structural configuration of the thickened areas of the container.

It will thus be seen that the present invention provides a unitary, collapsible container which nevertheless has the necessary rigidity to be normally self-supporting, and to receive a removable lid or cover. The collapsibility feature enables the container to be reduced in size as the container contents are removed, to thereby expel excess air and, at the same time, provide increased compactness. It will, of course, be appreciated that the container may be extended and collapsed repeatedly during use, and particularly when the container is utilized for general storage purposes, i.e., used over and over again, as opposed to being discarded after a first use. In view of this construction, it is also possible, at least in some circumstances, to eliminate the need for exterior rigid containers.

Further objects and advantages of the invention will become apparent from the detailed description which follows.

BRIEF DESCRIPTION OF THE DRAWINGS

FIG. 1 is a perspective view of an exemplary container and associated lid in accordance with the invention with the lid separated from the container;

FIG. 2 is a top view taken along the line 2—2 in FIG. 1;

FIG. 3 is a partial cross-section of the container illustrated in FIG. 1, but with the lid attached;

FIG. 4 is a partial cross-section illustrating an alternative sidewall/bottom wall construction in accordance with the invention;

FIG. 5 is a partial cross-section illustrating another alternative sidewall/bottom wall construction in accordance with the invention;

FIG. 6 is a perspective view of another exemplary embodiment of the invention, with the container shown in a fully extended condition;

FIG. 7 illustrates the container of FIG. 6 in a fully collapsed condition;

FIG. 8 is a split cross-sectional view of the container shown in FIGS. 6 and 7, illustrating the container in extended and collapsed positions;

DETAILED DESCRIPTION OF THE DRAWINGS

Figure 9:
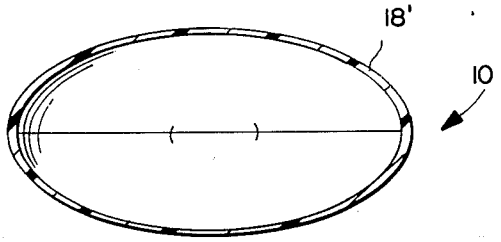
FIGS. 9 and 10 are top views illustrating alternative cross-sectional shapes for the containers in accordance with the invention.

With reference now to FIGS. 1–3, a container in accordance with a first exemplary embodiment of the invention is generally indicated by numeral 10 and includes a peripheral sidewall 12, an integral bottom wall 14 and an upper open end 16.

The peripheral sidewall 12 is provided with differential thicknesses along the height of the sidewall. Specifically, a thin sidewall portion 18 extends over the major portion of the height of the sidewall intermediate the upper and lower end portions of the container. A thickened portion 20 is provided about a lower portion of the sidewall 12, which merges with the bottom wall 14, as best seen in FIG. 3. Another thickened portion 22 is provided about the upper, open end 16 of the container, and this portion also includes means for receiving a removable lid or cover as will be explained in greater detail below.

In this first exemplary embodiment, the container has a substantially cylindrical shape, and is of substantially uniform diameter from upper end to lower end, with the exception of a relatively slight taper at the upper open end thereof. One exemplary diameter for the open end is about 100 mm, i.e., large enough for insertion of a hand, to thereby facilitate removal of the contents thereof. Of course, other diameters for the open end, as well as for the container in general, are also within the scope of the invention.

In this exemplary embodiment, thin portion 18 of the sidewall has a thickness of about 0.002 to 0.003 inch. The thickened lower portion 20, as well as bottom wall 14, have a thickness of about 0.010 inch, while the thickened upper portion 22 has a thickness in the range of about 0.020 to 0.030 inch.

As already noted, the thin wall portion 18 comprises the major portion of the peripheral sidewall 12, and this portion is axially collapsible to a relatively stable collapsed condition upon exertion of compressive pressure applied at either or both ends. The thickened bottom wall 14, as well as the thickened portion 20 of the sidewall permit the container to stand in a normally upright position. At the same time, the thickened upper portion 22 provides the necessary rigidity to maintain the shape of the open end 16, and to enable repeated attachment and removal of a lid or cover 24.

In this latter regard, the upper thickened portion 22 is formed so as to provide a first annular bead 26 and a second annular bead 28 which provides a rounded shoulder portion 30. This arrangement permits the lid 24, which has a depending peripheral skirt 32 terminating in a radially inwardly directed flange 34, to be repeatedly snapped onto the container, as shown in FIG. 3, while permitting the lid to be relatively easily removed as well.

The combination of differential peripheral sidewall thicknesses as described above permits the container to be collapsed from a fully extended condition shown in FIG. 1, to the relatively stable collapsed condition similar to that illustrated in FIG. 8 (which is directed to an alternative embodiment).

The container of this invention is especially useful in the food industry where items such as crackers, potato chips, etc. are packaged in a stacked condition within an individual bag-like container which is initially sealed at the upper end by conventional adhesive, heat sealing, etc. Once opened, however, these bags are difficult to close, especially to the extent required to keep the remaining contents fresh. With the above described container, the sidewall can be collapsed by exertion of an axial force about the remaining contents, thereby expelling excess air, and the removable lid reapplied over the relatively rigid opening at the upper end thereof to re-seal the container.

There are a number of variations in the construction of the container which are within the scope of the invention. For example, in the above described exemplary embodiment, the thickened bottom wall 14 merges with a thickened lower portion 20 of the peripheral sidewall. FIG. 4 illustrates an alternative design wherein the thickened bottom wall 14′ merges directly to the thinned peripheral sidewall 18′. Thus, in this alternative embodiment, the thickened lower sidewall portion 20 has been eliminated. This arrangement permits a slightly greater degree of collapsibility while nevertheless maintaining a relatively rigid base, i.e., the bottom wall 14′.

In FIG. 5, still another alternative embodiment is illustrated wherein the bottom wall 14″ is thickened only in the central region thereof, the outer peripheral portion having a thickness substantially identical to that of the thinned sidewall 18″.

With reference now to FIGS. 5–7, another exemplary embodiment of the invention is shown wherein the thickened upper portion 22′ is provided with a radially outwardly extending peripheral bead 34′ which includes a substantially flat, horizontal surface 36, and wherein, unlike the FIG. 1 embodiment, the underside of the bead merges directly with the thinned peripheral portion 18 of the sidewall, as at 38. In addition, the lower thickened portion 20′ of the sidewall is formed at its upper end with a radially outwardly directed peripheral bead 40 which, in turn, merges directly into the thinned portion 18.

As is best seen in the collapsed half of FIG. 8, the upper peripheral bead 34′ may be flexibly snapped behind the lower peripheral bead 40, so that the bag is retained in the collapsed position. It will be appreciated, however, that by pulling axially upwardly on the upper portion of the container, while holding the lower portion, the upper peripheral bead 34′ may be pulled out of engagement with lower bead 40 and out of the collapsed position to expand the container as desired.

In moving the container from its extended position (FIG. 6 and the left side of FIG. 8) to its collapsed position (FIG. 7 and the right side of FIG. 8), the container itself is transformed from one with a major portion thereof comprising a relatively thin film-like sidewall (FIG. 16), to a compact container which is essentially of rigid construction (FIG. 7). It is further apparent that the collapsed portion of the peripheral side wall lies radially within the periphery of the compact container, as defined by the maximum diameter portions of the upper and lower ends of the container, i.e., beads 34′ and 40.

Figure 10:
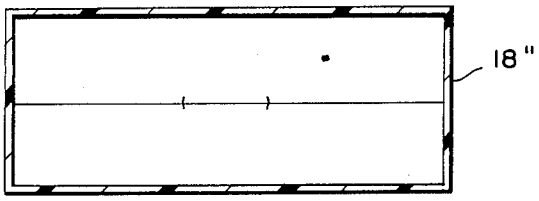

As indicated earlier, the container is preferably extruded and blow molded, although other forming processes may be utilized. This, of course, permits other cross-sectional container shapes to be formed. For example, FIG. 9 illustrates the open upper end 16' of an oval-shaped container, while FIG. 10 illustrates the open upper end 16" of a rectangular-shaped container.

Figure 11:
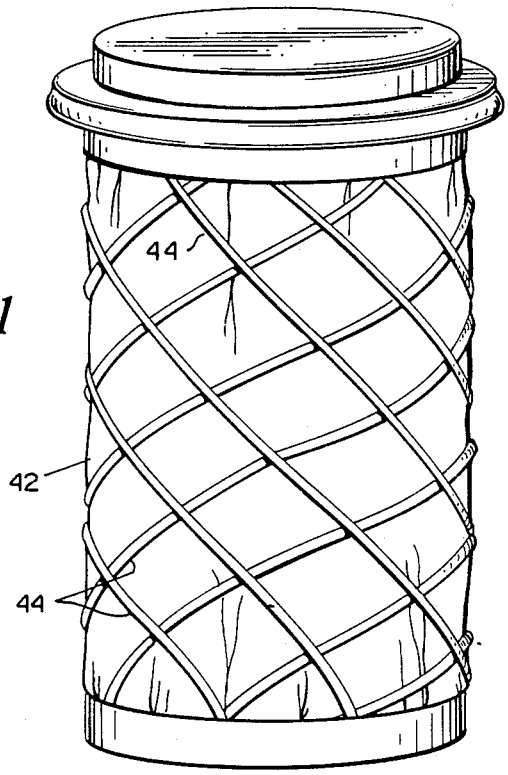
FIG. 11 is a perspective view of still another exemplary embodiment of the invention.

The inherent flexibility of the blow molding process permits other wall configurations as well. In this regard, reference is made to FIG. 11 which illustrates still another exemplary embodiment of the subject invention wherein the thinned peripheral sidewall portion 42 is formed with a "quilt" pattern of ribs 44 which provide additional rigidification for the container, but without eliminating the collapsibility feature.

The containers described above may be formed of any suitable thermoplastic material, e.g., polyvinylchloride, or polyolefins such as polypropylene or polyethylene.

While the invention has been described in connection with what is presently considered to be the most practical and preferred embodiment, it is to be understood that the invention is not to be limited to the disclosed embodiment, but, on the contrary, is intended to cover various modifications and equivalent arrangements included within the spirit and scope of the appended claims.

What is claimed is:

1. A reuseable and collapsible, one-piece blow-molded, stand-alone container having an upper open end provided with closure receiving means, a lower end, and a peripheral sidewall of predetermined axial length, the lower end being closed by an integral bottom wall, and wherein said peripheral sidewall has a substantially uniform cross-sectional area from said upper open end to said lower end and has a thickness in an upper, minor portion thereof of from about 0.020 to 0.030 inch, and a thickness in an intermediate, major portion of from about 0.002 to 0.003 inch, wherein said peripheral sidewall is self-supporting, but the major portion of which is collapsible to a relatively stable collapsed position upon exertion of an axial force applied at the upper or lower end thereof, such that, in said stable collapsed position, the major collapsed portion lies radially within the periphery of at least the lower end of the container.

2. A container according to claim 1 wherein said upper minor portion and said lower minor portion are provided with means for releasable interlocking engagement upon collapse of said peripheral sidewall to thereby form a relatively rigid compact container.

3. A container according to claim 1 wherein a lower minor portion of said peripheral sidewall is provided with a thickness of about 0.010 inch.

4. A container according to claim 1 wherein the bottom wall has a thickness of about 0.010 inch.

5. A container according to claim 4 wherein a lower portion of said peripheral sidewall is provided with a thickness of about 0.010 inch.

6. A container according to claim 1 wherein the container has a cross-sectional shape that is substantially circular.

7. A container according to claim 1 wherein the container has a cross-sectional shape that is substantially oval.

8. A container according to claim 1 wherein said container is constructed of thermoplastic material.

9. A container according to claim 1 wherein said upper open end is provided with a removable lid.

10. A collapsible and reusable, stand-alone plastic container comprising a unitary body including a bottom wall, a peripheral side wall having a substantially uniform cross-sectional area between said bottom wall and an open upper end provided with closure receiving means, said peripheral side wall having a first thickness along a major length portion thereof which permits said major length portion to axial collapse upon exertion of an axial compressive force at either end of said container to a relatively stable a collapsed condition wherein said major length portion lies radially inwardly of a lower non-collapsed portion of said peripheral side wall and wherein an upper portion of said peripheral side wall and at least said bottom wall have thicknesses greater than said first thickness.

11. A container assembly according to claim 10 wherein said container comprises an blow molded body of thermoplastic material.

12. A container assembly according to claim 10 wherein said unitary body is substantially circular in cross-section along substantially its entire length.

13. A container assembly according to claim 10 wherein said unitary body is substantially oval in cross-section along substantially its entire length.

14. A container assembly according to claim 10 wherein said closure receiving means includes annular bead means for receiving a snap-on lid.

15. A container assembly according to claim 10 wherein the upper portion of the peripheral sidewall has a thickness at least about twice as great as said bottom wall.

16. A container assembly according to claim 15 wherein the upper portion of the peripheral sidewall has a thickness about three times a great as said bottom wall.

17. A container assembly according to claim 15 wherein the upper portion of the peripheral side wall has a thickness about ten times greater than said first thickness.

18. A container assembly according to claim 17 wherein said bottom wall has a thickness of about 0.010 inch.

19. A plastic container assembly according to claim 10 and wherein said peripheral sidewall has a lower portion having a thickness greater than said first thickness.

20. A plastic container assembly according to claim 19 wherein said upper portion and said lower portion are provided with means for releasable interlocking engagement upon collapse of said peripheral sidewall.

21. A container assembly according to claim 12 wherein said substantially circular unitary body has a diameter at its upper open end of about 100 mm.

22. A container assembly according to claim 10 wherein said open upper end is provided with a removeable lid.

* * * * *